US011084553B2

(12) United States Patent
Souza et al.

(10) Patent No.: US 11,084,553 B2
(45) **Date of Patent: *Aug. 10, 2021**

(54) FLOATING OFFSHORE STRUCTURES WITH ROUND PONTOONS

(71) Applicant: HORTON DO BRASIL TECNOLOGIA OFFSHORE, LTDA., Rio de Janeiro (BR)

(72) Inventors: Marcelo I. L. Souza, Rio de Janeiro (BR); Lyle David Finn, Sugar Land, TX (US); Xavier Castello, Rio Grande (BR); Rodrigo M. R. Guimarães, Rio de Janeiro (BR); Luiz Germano Bodanese, Rio de Janeiro (BR); Rafael Bodanese, Macaé (BR)

(73) Assignee: HORTON DO BRASIL TECHNOLOGIA OFFSHORE, LTDA., Rio de Janeiro (BR)

( * ) Notice: Subject to any disclaimer, the term of this patent is extended or adjusted under 35 U.S.C. 154(b) by 0 days.

This patent is subject to a terminal disclaimer.

(21) Appl. No.: 16/438,133

(22) Filed: Jun. 11, 2019

(65) Prior Publication Data

US 2019/0291820 A1 Sep. 26, 2019

Related U.S. Application Data

(63) Continuation of application No. 15/808,057, filed on Nov. 9, 2017, now Pat. No. 10,358,188.

(Continued)

(51) Int. Cl.

| | |
|---|---|
| ***B63B 1/10*** | (2006.01) |
| ***B63B 35/44*** | (2006.01) |
| ***B63B 1/12*** | (2006.01) |

(52) U.S. Cl.

CPC ..... *B63B 1/107* (2013.01); *B63B 35/4413* (2013.01); *B63B 2001/123* (2013.01); *B63B 2001/126* (2013.01); *B63B 2001/128* (2013.01)

(58) Field of Classification Search

CPC ..... B63B 1/107; B63B 35/4413; B63B 2001/128; B63B 2001/123;

(Continued)

(56) References Cited

U.S. PATENT DOCUMENTS 3,224,401 A * 12/1965 Kobus ..... B63B 1/107 114/265
3,673,974 A * 7/1972 Harper ..... B63B 1/107 114/265

(Continued)

FOREIGN PATENT DOCUMENTS

EP 2691289 B1 12/2014
JP 45-27268 9/1970

(Continued)

OTHER PUBLICATIONS

Korean Office Action dated Jun. 15, 2020, for Korean Application No. 10-2019-7015723 (8 p.).

(Continued)

*Primary Examiner* — Anthony D Wiest
(74) *Attorney, Agent, or Firm* — Conley Rose, P.C.

(57) ABSTRACT

A floating offshore structure includes a buoyant hull including a first column, a second column, and a pontoon coupled to the first column and the second column. The pontoon extends horizontally from the first column to the second column. The pontoon includes a first tubular member, a second tubular member positioned laterally adjacent to the first tubular member, a first edge plate extending horizontally from the first tubular member, and a second edge plate extending horizontally from the second tubular member. The (Continued)

first tubular member and the second tubular member are disposed between the first edge plate and the second edge plate. Each tubular member has a central axis, a first end coupled to the lower end of the first column, and a second end coupled to the lower end of the second column. The longitudinal axis of the first tubular member and the longitudinal axis of the second tubular member are disposed in a common horizontal plane.

15 Claims, 4 Drawing Sheets

Related U.S. Application Data

(60) Provisional application No. 62/419,828, filed on Nov. 9, 2016.

(58) Field of Classification Search
CPC ..... B63B 2001/126; B63B 35/44; B63B 2035/442; E21B 15/02
USPC ..... 114/256, 264, 265, 266, 267
See application file for complete search history.

(56) References Cited

U.S. PATENT DOCUMENTS

| | | | | |
|---|---|---|---|---|
| 4,018,179 | A | 4/1977 | Rutter | |
| 4,685,409 | A | 8/1987 | Liden | |
| 5,653,188 | A | 8/1997 | Molin | |
| 6,761,124 | B1 | 7/2004 | Srinivasan | |
| 6,997,132 | B2 | 2/2006 | Steen | |
| 7,270,071 | B1 | 9/2007 | Shivers, III et al. | |
| 7,887,262 | B2 | 2/2011 | Astrand | |
| 8,418,640 | B2 * | 4/2013 | Leverette | B63B 1/107 114/264 |
| 8,967,068 | B2 * | 3/2015 | Yang | B63B 39/06 114/265 |
| 9,302,747 | B2 * | 4/2016 | Lambrakos | B63B 39/06 |
| 2004/0141812 | A1 | 7/2004 | Busso | |
| 2010/0024705 | A1 * | 2/2010 | Leverette | B63B 35/4413 114/264 |
| 2011/0253023 | A1 | 10/2011 | Tahar et al. | |
| 2012/0114421 | A1 | 5/2012 | Van Den Haak et al. | |
| 2015/0016892 | A1 | 1/2015 | Muehlner et al. | |

FOREIGN PATENT DOCUMENTS

| | | | |
|---|---|---|---|
| JP | 59-223594 | A | 12/1984 |
| JP | 5707593 | B2 | 4/2015 |
| KR | 20120132269 | A | 12/2012 |
| KR | 101285522 | B1 | 7/2013 |
| KR | 20150101051 | B1 | 9/2015 |
| WO | 01/56872 | A1 | 8/2001 |

OTHER PUBLICATIONS

English Summary of Korean Office Action dated Jun. 15, 2020, for Korean Application No. 10-2019-7015723 (4 p.).
European Search Report dated Jun. 25, 2020, for European Application No. 17868615.0 (6 p.).
PCT/US2017/060799 International Search Report and Written Opinion dated Jan. 24, 2018 (15 p.).
Office Action dated Sep. 27, 2018 for U.S. Appl. No. 15/808,057 (12 p.).
Response to Office Action dated Sep. 27, 2018 for U.S. Appl. No. 15/808,057; Response filed Dec. 27, 2018 (16 p.).
Notice of Allowance dated Mar. 27, 2019 for U.S. Appl. No. 15/808,057 (7 p.).
Chinese Office Action dated Nov. 5, 2020, for Chinese Application No. 1201780069319.1 (8 p.).
Japanese Office Action dated May 11, 2021, for Japanese Application No. 2019-545905 (2951-01109) (5 p.).
English Summary of Japanese Office Action dated May 11, 2021, for Japanese Application No. 2019-545905 (1 p.).

* cited by examiner

FLOATING OFFSHORE STRUCTURES WITH ROUND PONTOONS

CROSS-REFERENCE TO RELATED APPLICATIONS

This application is a continuation of U.S. application Ser. No. 15/808,057 filed Nov. 9, 2017, and entitled "Floating Offshore Structures with Round Pontoons," which claims benefit of U.S. provisional patent application Ser. No. 62/419,828 filed Nov. 9, 2016, and entitled "Floating Offshore Structures with Round Pontoons," each of which is hereby incorporated herein by reference in their entirety for all purposes.

STATEMENT REGARDING FEDERALLY SPONSORED RESEARCH OR DEVELOPMENT

Not applicable.

BACKGROUND

Field of the Disclosure

The disclosure relates generally to floating offshore structures. More particularly, the disclosure relates to buoyant semi-submersible offshore platforms for offshore drilling and/or production operations. Still more particularly, the disclosure relates to the geometries of the hulls of semi-submersible offshore platforms, and in particular, the horizontal pontoons of the hull.

Background to the Disclosure

In oilfield activities, semi-submersible floating structures or platforms are used for various types of offshore operations including offshore drilling and production of oil and gas, as well as offshore construction operations. Conventional semi-submersible offshore platforms typically include a hull that provides sufficient buoyancy to support a work deck above the surface of the water, as well as rigid and/or flexible piping or risers extending from the platform to the seafloor. The hull often includes a horizontal base that supports a plurality of vertically oriented columns, which in turn support the work deck above the surface of the water. In general, the size of the pontoons and the number of columns are governed by the size and weight of the work platform and associated payload to be supported by the hull.

BRIEF SUMMARY OF THE DISCLOSURE

Embodiments of floating offshore structures are disclosed herein. In one embodiment, a floating offshore structure comprises a buoyant hull including a first column, a second column, and a pontoon coupled to the first column and the second column. Each column is vertically oriented and the pontoon extends horizontally from the first column to the second column. Each column has a central axis, an upper end, and a lower end. The pontoon includes a first tubular member, a second tubular member positioned laterally adjacent to the first tubular member, a first edge plate extending horizontally from the first tubular member, and a second edge plate extending horizontally from the second tubular member. The first tubular member and the second tubular member are disposed between the first edge plate and the second edge plate. Each tubular member has a central axis, a first end coupled to the lower end of the first column, and a second end coupled to the lower end of the second column. The longitudinal axis of the first tubular member and the longitudinal axis of the second tubular member are disposed in a common horizontal plane.

In another embodiment, a floating offshore structure comprises a buoyant hull including a first column, a second column, and a pontoon extending from the first column to the second column. Each column is vertically oriented and has a central axis, an upper end, and a lower end. The pontoon includes a first cylindrical tubular member, a second cylindrical tubular member oriented parallel to the first tubular member, a first heave plate extending horizontally from the first cylindrical tubular member, and a second heave plate extending horizontally from the second cylindrical tubular member. The first cylindrical tubular member and the second tubular member are disposed between the first heave plate and the second heave plate. The first heave plate and the second heave plate are configured to dampen vertical movement of the floating offshore structure. The second cylindrical tubular member is positioned laterally adjacent to the first cylindrical tubular member. Each tubular member is horizontally oriented and has a central axis, a first end coupled to the lower end of the first column, and a second end coupled to the lower end of the second column.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of the disclosed exemplary embodiments, reference will now be made to the accompanying drawings, wherein.

NOTATION AND NOMENCLATURE

Figure 1:
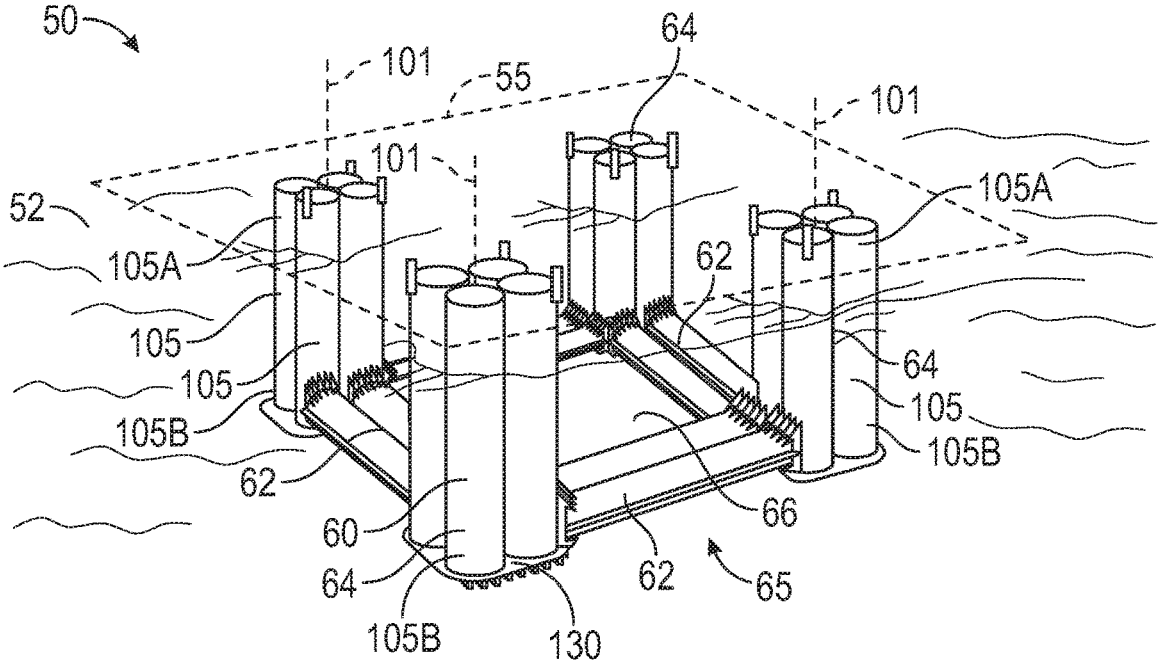
FIG. 1 is a perspective view, partially in schematic form, of an embodiment of an offshore semi-submersible platform in accordance with principles described herein.

The following description is exemplary of certain embodiments of the disclosure. One of ordinary skill in the art will understand that the following description has broad application, and the discussion of any embodiment is meant to be exemplary of that embodiment, and is not intended to suggest in any way that the scope of the disclosure, including the claims, is limited to that embodiment.

The figures are not necessarily drawn to-scale. Certain features and components disclosed herein may be shown exaggerated in scale or in somewhat schematic form, and some details of conventional elements may not be shown in the interest of clarity and conciseness. In some of the figures, in order to improve clarity and conciseness, one or more components or aspects of a component may be omitted or may not have reference numerals identifying the features or components. In addition, within the specification, including the drawings, like or identical reference numerals may be used to identify common or similar elements.

As used herein, including in the claims, the terms "including" and "comprising," as well as derivations of these, are used in an open-ended fashion, and thus are to be interpreted to mean "including, but not limited to . . . ." Also, the term "couple" or "couples" means either an indirect or direct connection. Thus, if a first component couples or is coupled to a second component, the connection between the components may be through a direct engagement of the two components, or through an indirect connection that is accomplished via other intermediate components, devices and/or connections. The recitation "based on" means "based at least in part on." Therefore, if X is based on Y, then X may be based on Y and on any number of other factors. The word "or" is used in an inclusive manner. For example, "A or B" means any of the following: "A" alone, "B" alone, or both "A" and "B."

In addition, the terms "axial" and "axially" generally mean along a given axis, while the terms "radial" and "radially" generally mean perpendicular to the axis. For instance, an axial distance refers to a distance measured along or parallel to a given axis, and a radial distance means a distance measured perpendicular to the axis. As understood in the art, the use of the terms "parallel" and "perpendicular" may refer to precise or idealized conditions as well as to conditions in which the members may be generally parallel or generally perpendicular, respectively. Furthermore, any reference to a relative direction or relative position is made for purpose of clarity, with examples including "top," "bottom," "up," "upward," "down," "lower," "clockwise," "left," "leftward," "right," "right-hand," "down", and "lower." For example, a relative direction or a relative position of an object or feature may pertain to the orientation as shown in a figure or as described. If the object or feature were viewed from another orientation or were implemented in another orientation, it may be appropriate to describe the direction or position using an alternate term. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

DETAILED DESCRIPTION OF PREFERRED EMBODIMENTS

As previously described, the hull of a floating semi-submersible platform typically includes a horizontal base and a plurality of vertical columns extending from the base. The base usually includes of a plurality of horizontal pontoons (e.g., 3 or more) connected end-to-end to form a closed loop structure with a large central opening. The lower ends of the columns are seated on top of the corners of the base (i.e., at the intersection of each pair of pontoons), and extend therefrom through the surface of the water to the work deck supported on the upper ends of the columns. The pontoons conventionally have a rectangular cross-sectional shape and are composed of flat stiffened panels. Due to the external pressure of water in combination with compressional loads from the weight of the work deck, the columns and pontoons typically require a combination of longitudinal and transversal stiffeners. The use of flat stiffened panels for the pontoons and stiffeners in the pontoons and columns increases manufacturing costs and structural weight. However, as will be described in more detail below, embodiments of floating offshore structures and hulls disclosed herein offer the potential to reduce manufacturing costs, as well as the overall weight of the hull.

During drilling or production operations, it is generally desirable to minimize the motion of the floating offshore structure to maintain the position of the platform over the well site to reduce the likelihood of damage to the risers extending from the structure to the sea floor. One component of offshore platform motion is heave, which is the vertical linear displacement of the platform in response to wave motion. The floating platform preferably has heave characteristics within acceptable limits to minimize riser fatigue and strength requirements. The heave characteristics of many conventional hull designs present unique challenges to the design of riser systems suitable for the induced dynamic loads and associated fatigue. However, as will be described in more detail below, embodiments of floating offshore structures and hulls disclosed herein offer the potential for improved heave characteristics.

Referring now to FIG. 1, an embodiment of a semi-submersible multicolumn floating offshore structure or platform 50 is shown. In FIG. 1, platform 50 is deployed in a body of water 52 and is anchored over an operation site with a mooring system. In this embodiment, offshore platform 50 includes an adjustably buoyant floating hull 60 and a work deck or topsides 55 mounted atop hull 60. Topsides 55 is supported by hull 60 above the surface of the water 52. Hull 60 includes a plurality of adjustably buoyant horizontal pontoons 62 and a plurality of adjustably buoyant parallel vertical columns 64 extending upward from pontoons 62. During deployment and installation of platform 50, the buoyancy of pontoons 62 and columns 64 may be adjusted, however, during operations with platform 50 after installation, pontoons 62 are usually flooded (e.g., do not provide any buoyancy) while columns 64 continue to provide adjustable buoyancy to platform 50.

Each pontoon 62 extends horizontally between the lower ends of each pair of laterally adjacent columns 64, thereby forming a closed loop base 65 with four corners and a central opening 66. Since pontoons 62 extend between the lateral sides of the lower ends of columns 64, base 65 may be described as being formed by the pontoons 62 and the lower ends of the columns 64. Although base 65 is shown as having a square geometry in this embodiment with each pontoon 62 having the same length, in other embodiments, the base (e.g., base 65) can have a different geometric shape such as rectangular, triangular, etc.

Columns 64 extend vertically from base 65 through the surface of water 52. Topsides 55 is mounted to hull 60 atop the upper ends of columns 64. In general, the equipment used in oil and gas drilling or production operations, such as a derrick, draw works, pumps, scrubbers, precipitators and the like is disposed on and supported by topsides 55. In this embodiment, risers or other conduits (not shown) pass through opening 66 in base 65 to topsides 55. In such embodiments, the risers or other conduits are directly supported at topsides 55. However, in other embodiments, the risers or other conduits may be directly supported by pontoons 62.

Figure 2:
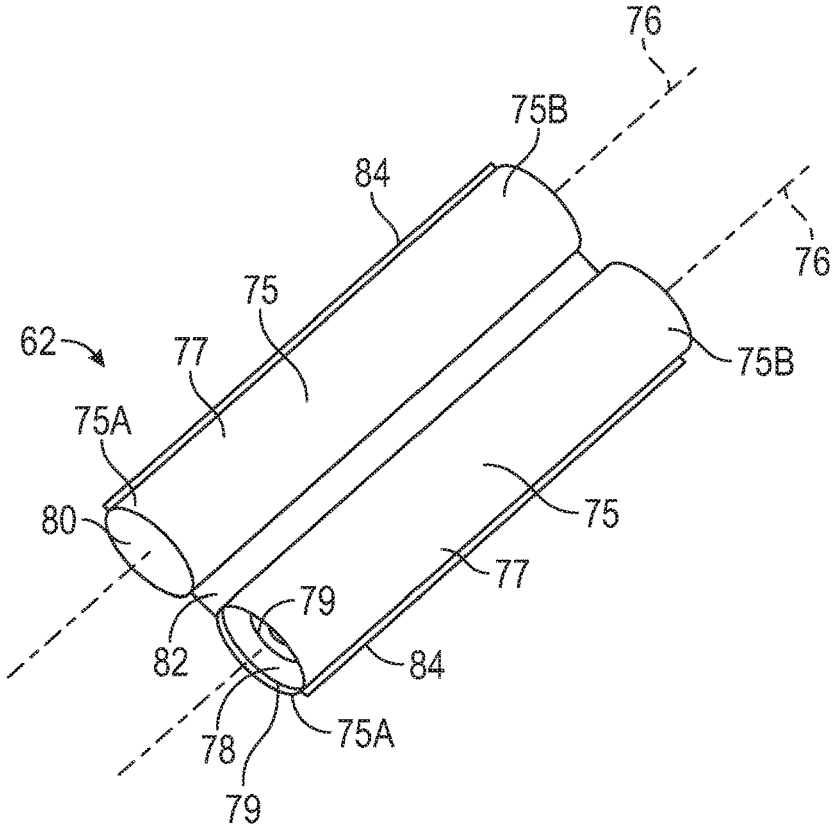
FIG. 2 is a perspective view of one of the pontoons of the semi-submersible platform of FIG. 1.

Referring now to FIG. 2, one pontoon 62 is shown and will be described with the understanding that the other pontoons 62 of hull 60 are the same. Pontoon 62 includes a plurality of straight, elongated, parallel cylindrical tubular members 75 coupled together side-by-side. In this embodiment, pontoon 62 includes two horizontal tubular members 75 fixably coupled side-by-side along their lengths with an elongate connecting plate 82. As used herein, the term "elongate" refers to a structure or component having a length (e.g., measured along a central or longitudinal axis) that is greater than a width or diameter (e.g., measured perpendicular to the central or longitudinal axis). Plate 82 extends horizontally between the pair of tubular members 75, and thus, the upper and lower surfaces of connecting plate 82 are disposed in horizontal planes with vertical surface vectors.

Referring now to FIGS. 1 and 2, each tubular member 75 has a linear (i.e., straight) central or longitudinal axis 76, a first end 75A fixably connected to the lateral side of the lower end of one column 64, and a second end 75B fixably connected to the lateral side of the lower end of another column 64. Thus, each tubular member 75 extends between two columns 64. In this embodiment, each tubular member 75 has the same length measured axially between ends 75A, 75B, and thus, each pontoon 62 has the same axial length. Axes 76 of tubular members 75 in the same pontoon 62 lie in a common horizontal plane, and further, axes 76 of tubular members 75 in all pontoons 62 of base 65 lie in a common horizontal plane.

As best shown in FIG. 2, each tubular member 75 includes a cylindrical side wall 77, an inner cavity 78, and plurality of axially-spaced annular stiffeners 79 mounted to the inner surface of side wall 77 within cavity 78. An end cap or plate 80 is mounted to each end 75A, 75B, thereby closing off and sealing cavity 78 within tubular member 75. In FIGS. 1 and 2, end plates 80 are flat plates oriented perpendicular to axis 76. In embodiments, cavity 78 can be divided into a plurality of distinct and separate ballast tanks. For example, a plurality of axially-spaced vertical bulkheads may be provided along tubular member 75 to define a plurality of axially adjacent ballast tanks. Such ballast tanks can be selectively filled with fixed ballast, adjustable ballast, a gas such as air, or combinations thereof to adjust the buoyancy of the corresponding tubular member 75, and hence, the corresponding pontoon 62 and base 65.

Figure 3:
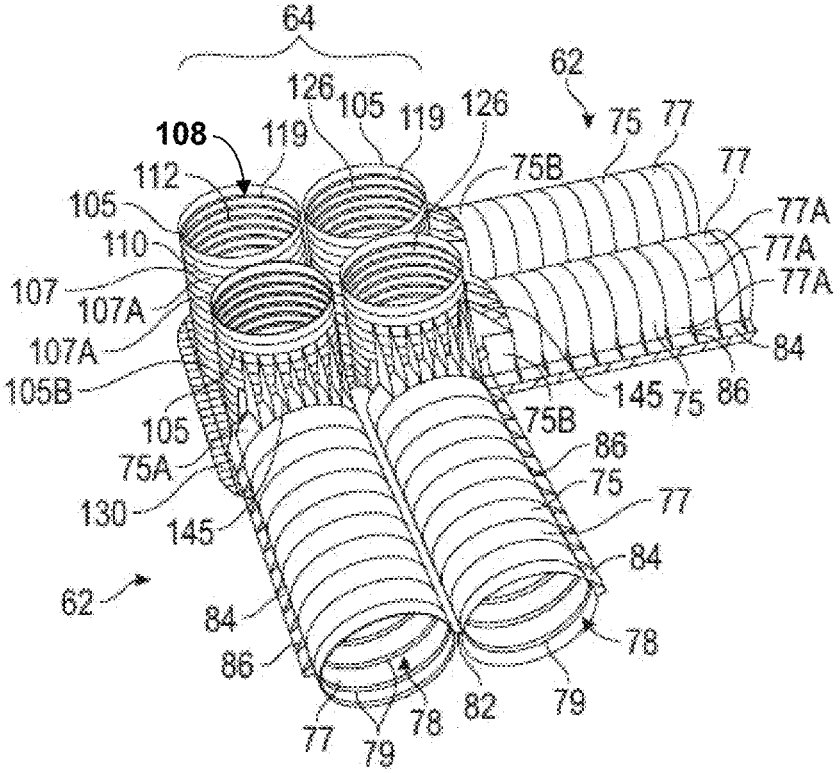
FIG. 3 is an enlarged perspective view of one of the corners of the hull of the semi-submersible platform of FIG. 1 illustrating truncated portions of one vertical column and two horizontal pontoons.

As shown in FIG. 3, tubular member 75 can be formed from a plurality of circular sections 77A joined together end-to-end. In this embodiment, sections 77A are not elongate, however, in other embodiments, the sections forming the tubular member (e.g., each section 77A of tubular member 75) are elongate. Alternatively, tubular member 75 can be formed from elongate rectangular piece of material (single piece or multiple pieces welded together to form a single piece) that is rolled and then welded lengthwise along a seam.

Referring now to FIGS. 2 and 3, a horizontal edge plate 84 is provided along each laterally side of each pontoon 62. Each plate 84 extends horizontally from the lateral side of the corresponding pontoon 62 and extends axially along the length of the corresponding pontoon 62. More specifically, one edge plate 84 extends horizontally from the outer surface of each tubular member 75 on its lateral side opposite connecting plate 82. In this embodiment, connecting plate 82 and edge plates 84 are disposed in a common horizontal plane, and further, are disposed at the vertical mid-section of cylindrical tubular members 75.

As shown in FIG. 3, a plurality of axially-spaced, vertically oriented gussets or brackets 86 extend from the upper and lower surfaces of each plate 84 to the outer surface of sidewall 77 of the corresponding tubular member 75. Each bracket 86 is axially aligned with one of the annular stiffeners 79. Brackets 86 reinforce and provide stiffness to edge plates 82. Connecting plate 82 and edge plates 84 provide structural integrity for pontoon 62, and provide dampening of vertical motion of platform 50 since they lie in a horizontal plane and induce drag and added mass that resists vertical movement. Thus, each of the plates 82, 84 may also be described as a "heave plate" that reduces the vertical motion of platform 50.

The side-by-side arrangement of multiple cylindrical tubular members 75 reduces or minimizes the vertical height of the corresponding pontoon 62 while simultaneously increasing or maximizing its horizontal width. Such geometry offers the potential to reduce lateral loads experienced by pontoons 62 and platform 50 that may arise due to ocean currents and waves, as well as reduce the heave of the platform 50 by increasing the vertical drag and added mass of pontoons 62. As a result, embodiments of pontoons described herein (e.g., pontoons 62) offer the potential to reduce the performance requirements and associated costs of mooring systems as compared to conventional pontoons designed to manage heave of a similarly sized conventional hull.

Referring now to FIGS. 1 and 3, each column 64 of hull 60 has a linear (i.e., straight) central or longitudinal axis 101 oriented vertically. Thus, axes 101 are perpendicular to axes 76 of cylindrical tubular members 75 in front and side view of hull 60. In addition, each column 64 includes a plurality of parallel, elongated cylindrical tubular members 105. Each tubular member 105 has a first or upper end 105A supporting topsides 55 and a second or lower end 105B attached to a pair of pontoons 62. In the embodiment shown in FIGS. 1 and 3, each column 64 includes four cylindrical tubular members 105 uniformly circumferentially-spaced about axis 101 of the corresponding column 64 and arranged side-by-side to define a generally square column 64. In addition, each tubular member 105 within a given column 64 is equidistant from axis 101 of the corresponding column 64.

Figure 4:
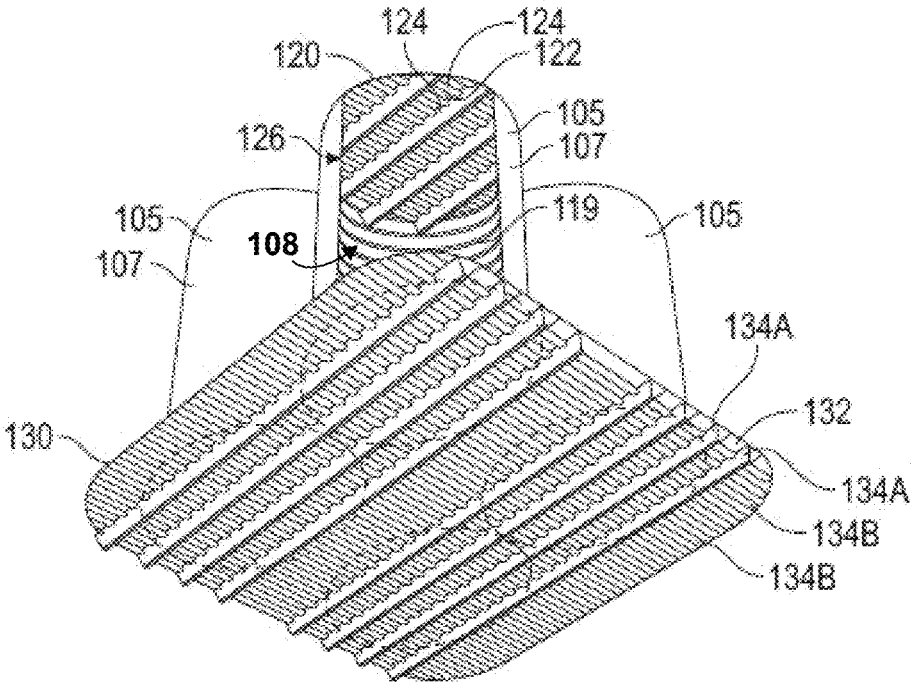
FIG. 4 is enlarged partial cross-sectional perspective bottom view of one of the columns of the semi-submersible platform of FIG. 1.

Referring now to FIGS. 3 and 4, each tubular member 105 includes a cylindrical side wall 107, an inner cavity 108, and plurality of axially-spaced annular stiffeners 119 mounted to the inner surface of side wall 107 within cavity 108. As best shown in FIG. 4, in this embodiment, inner cavity 108 of each tubular member 105 is divided into a plurality of vertically-stacked compartments 126 defined by a plurality of axially-spaced decks or bulkheads 120. Each bulkhead 120 includes a horizontally oriented flat plate 122 reinforced by two sets of stiffeners 124 oriented in perpendicular directions. Compartments 126 define a plurality of distinct and separate ballast tanks within each tubular member 105. Such ballast tanks can be selectively filled with fixed ballast, adjustable ballast, a gas such as air, or combinations thereof to adjust the buoyancy of the corresponding tubular member 105 and base 65.

Referring still to FIG. 4, the lower end 105B of each tubular member 105 within a given column 64 is capped and sealed by an external deck 130. In other words, a single horizontal deck 130 extends across, closes, and seals the lower end 105B of each tubular member 105 of the corresponding column 64. Deck 130 also defines a bulkhead or bottom panel for the lowermost ballast tank 126 of each member 105, thereby simplifying the design of hull 60 and eliminating the need for a separate, additional plates of material to close lower ends 105B. Each deck 130 includes a horizontal plate 132 reinforced by two sets of multiple stiffeners 134A, 134B that run in perpendicular directions. In this embodiment, each deck 130 has a generally square shape. In other embodiments, the deck (e.g., deck 130) may have a different shape (e.g., circular, rectangular, etc.).

As best shown in FIGS. 1 and 3, deck 130 extends horizontally (radially relative to axis 101) beyond the outer perimeter of the corresponding column 64 and associated tubular members 65. In general, the horizontal distance that each deck 130 extends (radially relative to axis 101) beyond the outer perimeter of the corresponding column 64 can be tailored to achieve the desired heave motion of hull 60 and platform 50. In embodiments described herein, the horizontal distance that each deck 130 extends (radially relative to axis 101) beyond the outer perimeter of the corresponding column 64 is preferably equal to or greater than the minimum horizontal distance between each pair of adjacent tubular members 105 of the corresponding column 64 (e.g., about 1 m) and less than or equal to the outer diameter of one tubular member 105 of the corresponding column 64; and more preferably about one-half the outer diameter of one tubular member 105 of the corresponding column 64. In the embodiment shown, deck 130 extends a short distance under ends 75A, 75B of cylindrical tubular members 75 secured to the corresponding column 64. The horizontal orientation and size of deck 130 (extending beyond the perimeter of the corresponding column 62) enables deck 130 to function as a heave plate that induces added mass for reducing heave of platform 50.

Similar to cylindrical tubular members 75 of pontoons 62, cylindrical tubular members 105 of columns 64 can be formed from a plurality of circular sections 107A joined together end-to-end. In this embodiment, sections 107A are not elongate, however, in other embodiments, each section 107A is elongate. Alternatively, tubular member 105 can be formed from elongate rectangular piece of material (single piece or multiple pieces welded together to form a single piece) that is rolled and then welded lengthwise along a seam.

Referring again to FIG. 3, one corner of base 65 is shown. In particular, the intersection of one column 64 and two pontoons 62 is shown with the corresponding deck 130. Although only one corner of base 65 is shown in FIG. 3, it should be appreciated that the other corners of base 65 are the same. As shown in FIG. 3, pontoon 62 is fixably coupled to column 64 via a plurality of connection assemblies 145—one connection assembly 145 is disposed between each pair of adjacent members 75, 105. More specifically, one end 75A, 75B of each tubular member 75 is positioned laterally adjacent the lower end 105B of a corresponding tubular member 105 and is fixably coupled thereto with one connection assembly 145.

Figure 5:
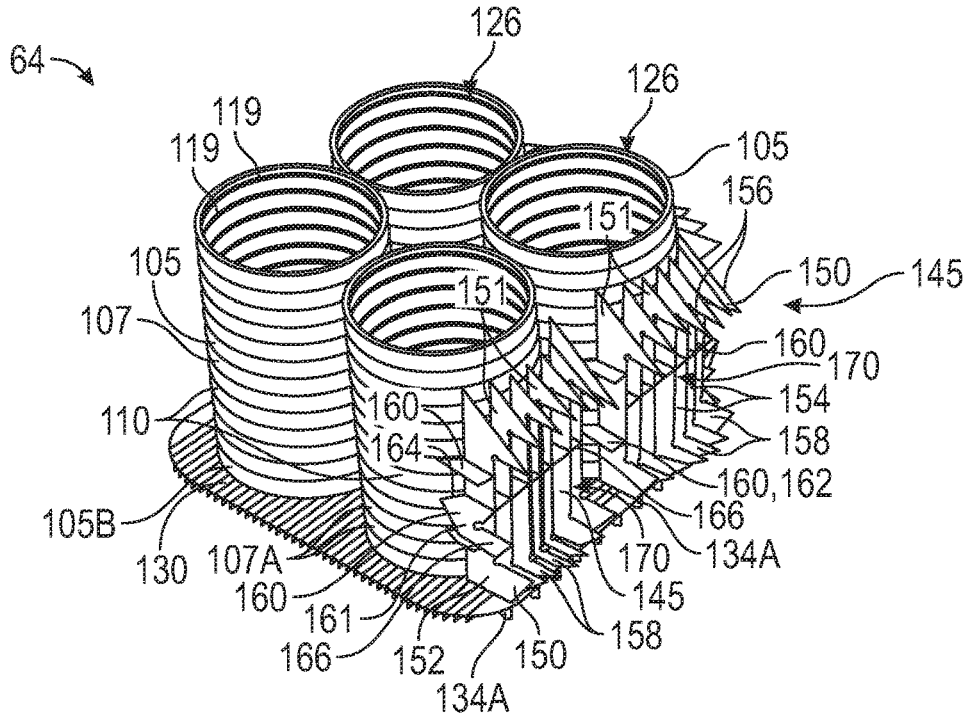
FIG. 5 is an enlarged perspective view of the truncated column of FIG. 3 with the pontoons removed.

As best shown in FIG. 5, in this embodiment, each connection assembly 145 includes a plurality of horizontally-spaced, vertically oriented brackets 150 and a plurality of vertically-spaced, horizontally oriented brackets 160. Brackets 150 are oriented parallel to each other and lie in planes oriented parallel axis 101, and brackets 160 are oriented parallel to each other and lie in planes oriented perpendicular to axis 101. In addition, brackets 150 are circumferentially spaced about a portion of the outer surface 110 of the corresponding member 105, while brackets 160 are vertically spaced about the portion of the outer surface 110 of the corresponding member 105. Brackets 150, 160 are fixably secured to the cylindrical outer surfaces of the corresponding members 75, 105. Each bracket 150 of each connection assembly 145 extends to the same end 75A, 75B of the corresponding tubular member 75, and thus, the circumferentially outer brackets 150 of each connection assembly 145 (e.g., brackets 150 disposed more proximal the lateral sides of assembly 145) extend horizontally a greater distance to the corresponding end 75A, 75B than the circumferentially inner brackets 150 (e.g., brackets 150 disposed more proximal the lateral center of assembly 145) to compensate for the curvature of the outer surface 110 of the corresponding tubular member 105.

Referring still to FIG. 5, each vertical bracket 150 includes a first or upper end 151, a second or lower end 152, a back section or spine 154 extending between ends 151, 152, a first or upper protrusion 156 extending horizontally from spine 154 (and away from tubular member 105) at upper end 151, and second or lower protrusion 158 extending horizontally from spine 154 (and away from tubular member 105) at lower end 152. The rear sides spines 164 attached to tubular members 105 are concave to match the curvature of outer surfaces 110. A vertically centered horizontal bracket 160 of each connection assembly 145 includes a first or outer end 161, a second or inner end 162, a back section or spine 164 extending between ends 161, 162, and an outer protrusion 166 extending horizontally from spine 164 at outer end 161. Inner end 162 is located between adjacent members 105 and does not include a protrusion in this embodiment so as not to interfere with the adjacent tubular member 105 or connecting plate 82. A generally circular recess 170 is defined by protrusions 156, 158, 166 with the front of spines 154, 164 distal the corresponding tubular member 105 lying in a common vertical plane. Circular recess 170 is sized and shaped to slidingly receive end 75A, 75B of the corresponding tubular member 75, which is welded to protrusions 156, 158, 166 and spines 154, 164. The inner face of recess 170 opposite the corresponding end 75A, 75B is flat to match the flat end 75A, 75*b* and flat end plate 80 of the corresponding tubular member 75. In some embodiments, connecting plate 82 between tubular members 75 is aligned with and sits adjacent the central horizontal brackets 160 extending from adjacent tubular members 105 and may be welded to two vertical brackets 150.

The use of an intermediate connection assembly 145 offers the potential to simplify the fabrication of pontoons 62 and the coupling of pontoons 62 to columns 64 by avoiding the complexity of saddle-type connections. As a result, pontoons 62 can be formed from cylindrical tubular members 75 have flat ends 75A, 75*b* that are closed and sealed by a flat end plate 80 before pontoons 62 are connected to columns 64. Thus, pontoons 62 can be fabricated, sealed, and tested before they are coupled to columns 64.

In this embodiment, each bracket 150 is co-planar with one of the stiffeners 134A, 134B of deck 130 with lower ends 152 coupled to deck 130 (e.g., welded), thereby providing structural continuity between connection assemblies 145, decks 130, pontoons 62, and columns 64. Brackets 150, 160 may be, for example, flat plates welded to members 75, 105 and deck 130 and may installed by any method known in the art. In the example of FIG. 5, brackets 150, 160 are spaced so as to allow access to welding machines and workers to carry out all welding procedure and inspection. Together, the vertical and horizontal brackets 150, 160, and the stiffeners 134A, 134B are configured to distribute a load, provide structural continuity, and avoid stress concentrations. Manufacturing and inspection are expected to be simpler and more cost effective than traditional saddle connections.

In the embodiment shown in FIGS. 1-3, each tubular member 75 is self-contained, such that cavities 78 of the adjacent tubular members 75 of each pontoon 62 are structurally separated and isolated from each other, from tubular members 105, and from other tubular members 75. However, in other embodiments, the volumes 78 or their ballast tanks may be interconnected to other members 75 or columns 64 by plumbing.

Figure 6:
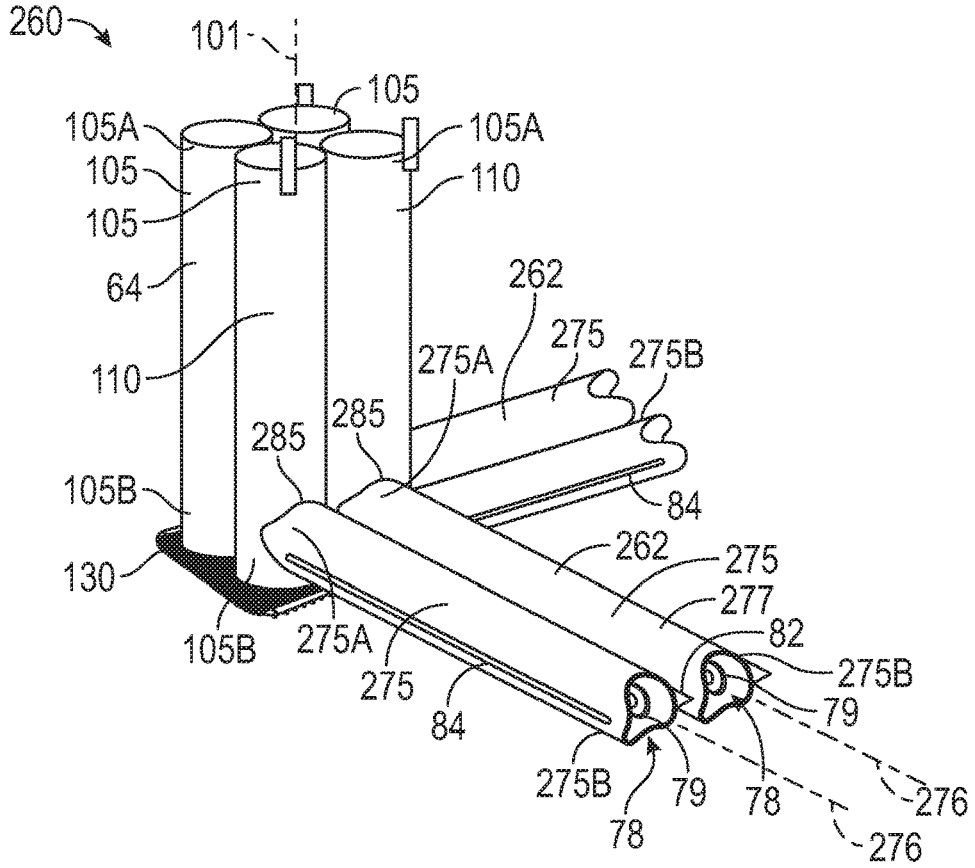
FIG. 6 is an enlarged partial perspective view of an embodiment of a hull for an offshore semi-submersible platform in accordance with the principles described and illustrating one corner of the hull including truncated portions of one vertical column and two horizontal pontoons.

Referring now to FIG. 6, one corner of another embodiment of a hull 260 for a floating offshore structure is shown. Hull 260 supports a topsides (e.g., topsides 55) above the surface of a body of water, and may replace hull 60 of platform 50 shown in FIG. 1. In this embodiment, hull 260 includes a plurality of adjustably buoyant horizontal pontoons 262 coupled to the lower ends of a plurality of adjustably buoyant column 64. Although only one corner of hull 260 is shown in FIG. 6, it is to be understood that hull 260 includes a plurality of vertical columns 64, a plurality of horizontal pontoons 262 connected to the lower ends of the columns 64 and forming a closed-loop base similar to base 65 previously described. Each corner of hull 260 is the same as shown in FIG. 6, and thus, one corner of hull 260 will be described with the understanding the other corners of hull 260 are the same.

Column 64 is as previously described. Pontoons 262 are substantially the same as pontoons 62 previously described with the exception of the ends of pontoons 262 and the interface between pontoons 262 and columns 64. More specifically, each pontoon 262 includes a plurality of straight, elongated, horizontally oriented tubular members 275 connected laterally side-by-side. In this embodiment, two parallel, tubular members 275 are connected side-by-side by a horizontal connecting plate 82 as previously described to form the pontoon 262. Pontoon 262 has a linear (i.e., straight) central or longitudinal axis 276, a first end 275A fixably coupled to the lower end of one column 64, and a second end 275B fixably coupled to the lower end of another column 64. Each end 275A, 275B of each tubular member 275 has a concave contoured shape or saddle that mates with and fits partially around cylindrical outer surface 110 of the corresponding tubular member 105. Similar to cylindrical tubular members 75 previously described, in this embodiment, each tubular member 275 includes a cylindrical side wall 277, an inner cavity 78, and a plurality of annular stiffeners 79 axially spaced along the inner surface of wall 277. However, member 275 lacks an end cap or end plate at ends 275A, 275B. Instead, cavity 78 is sealed at the intersection of ends 275A, 275B and the lower end of one of the corresponding column 64, as will be described in more detail below. Tubular member 275 also includes a plurality of axially adjacent ballast tanks defined by axially-spaced bulkheads. In general, tubular members 275 can be formed in the same manner as cylindrical tubular members 75 previously described (e.g., elongate material, possibly rolled and welded lengthwise or from multiple, short circular sections joined end-to-end).

Referring still to FIG. 6, pontoon 262 includes two reinforced, horizontal edge plates 84 as previously described extending axially, along the outer surface of tubular members 275. Connecting plate 82 and edge plates 84 provide structural integrity for pontoon 262 and provide dampening of vertical motion, and thus, may be described as horizontal heave plates. In this embodiment, plates 82, 84 are disposed in a common horizontal plane and are vertically positioned at the middle of tubular members 275.

Axes 276 of tubular members 275 are located in the same horizontal plane. As previously described with respect to pontoon 62, the side-by-side arrangement of multiple tubular members 275 reduces or minimizes the vertical height of the corresponding pontoon 262 while simultaneously increasing or maximizing its horizontal width. This geometry offers the potential to reduce lateral loads experienced by pontoons 262 and the associated platform that may arise due to ocean currents and waves, as well as reduce the heave of the platform 50 by increasing the vertical drag and added mass of pontoons 262. As a result, use of embodiments of pontoons described herein such as pontoons 262 offer the potential to reduce the performance requirements and associated costs of mooring systems as compared to those that may be necessary to manage heave of a similarly sized conventional hull.

Referring still to FIG. 6, each pontoon 262 is coupled to a corresponding tubular member 64 with connections 285—one connection 285 is provided between each tubular member 275 and a corresponding tubular member 105. In particular, each tubular member 275 is positioned adjacent one of the vertical tubular members 105 and is coupled to the lower end 105B of that tubular member 105 with one connection 285. Each connection 285 is a saddle-type connection in which the contoured end 275A, 275B of the tubular member 275 wraps partially around outer surface 110 of the corresponding tubular member 105 and is coupled directly thereto (e.g., welded). In this embodiment, connection 285 does not include any gussets or brackets extending between the coupled members 275, 105, however, in other embodiments, such features may be added. To ensure sufficient space to accommodate connection 285 between each tubular member 275 and corresponding tubular member 105, the outer diameter of each tubular member 275 is less than the outer diameter of the corresponding tubular member 105. In particular, the outer diameter of each tubular member 275 is preferably 80 to 90% of the outer diameter of the corresponding tubular member 105.

Figure 7:
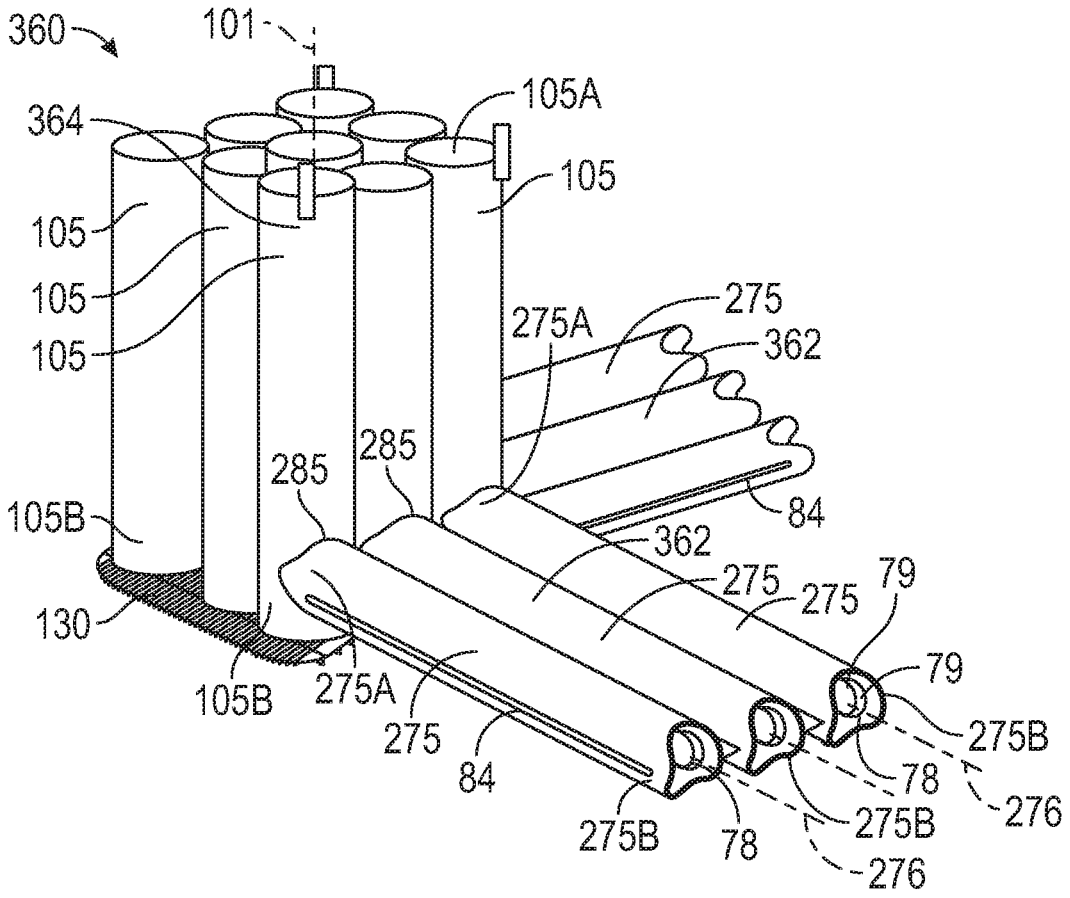
FIG. 7 is an enlarged partial perspective view of an embodiment of a hull for an offshore semi-submersible platform in accordance with the principles described and illustrating one corner of the hull including truncated portions of one vertical column and two horizontal pontoons.

Referring now to FIG. 7, one corner of another embodiment of a hull 360 for a floating offshore structure is shown. Hull 360 supports a topsides (e.g., topsides 55) above the surface of a body of water, and may replace hull 60 of platform 50 shown in FIG. 1. In this embodiment, hull 360 includes a plurality of adjustably buoyant horizontal pontoons 362 coupled to the lower ends of a plurality of adjustably buoyant column 364. Although only one corner of hull 360 is shown in FIG. 7, it is to be understood that hull 360 includes a plurality of vertical columns 364, a plurality of horizontal pontoons 362 connected to the lower ends of the columns 364 and forming a closed-loop base similar to base 65 previously described. Each corner of hull 360 is the same as shown in FIG. 7, and thus, one corner of hull 360 will be described with the understanding the other corners of hull 360 are the same.

Pontoon 362 extends from the lower end of column 364. Similar to pontoon 262, each pontoon 362 includes a plurality of straight, elongated, tubular members 275 as previously described arranged horizontally side-by-side. However, in this embodiment, three parallel, tubular members 275 are connected by horizontal connecting plates 82—one plate 82 as previously described is disposed between each pair of adjacent tubular members 275 of pontoon 362. In addition, pontoon 362 further includes two reinforced, horizontal edge plates 84 extending lengthwise (i.e., axially) along outer regions of the two outermost tubular members 275. In this embodiment, plates 82, 84 are disposed in a common horizontal plane and are vertically positioned at the middle of tubular members 275. Connecting plate 82 and edge plates 84 provide structural integrity for pontoon 362 and provide dampening of vertical motion of platform 50, being thus configured to perform as horizontal heave plates.

Axes 276 of tubular members 275 are located in the same horizontal plane. As previously described with respect to pontoon 62, the side-by-side arrangement of tubular members 275 reduces or minimizes the vertical height of pontoon 362 and increases or maximizes its width in that horizontal plane. This configuration of makes pontoon 362 and hull 360 less susceptible to lateral forces that may arise due to ocean currents and waves. As well, this configuration increases the vertical drag of pontoon 362, configuring it to reduce the heave motions of platform 50. As a consequence, the use of pontoons 362 may allow the use of smaller or less costly mooring systems than would be used for a conventional hull.

Still referencing FIG. 7, column 364 of the hull 360 is substantially the same as column 60 previously described. In particular, column 364 includes a plurality of vertical cylindrical tubular members 105 as previously described coupled to each other and sealed by a lower, external deck 130, which functions as a heave plate. However, in this embodiment, column 364 comprises nine cylindrical tubular members 105 extending parallel to a vertically-oriented, central or longitudinal axis 101. Tubular members 105 are arranged in a generally square configuration with three tubular members 105 disposed along each side and one central tubular member 105 surrounded by the others.

Each pontoon 362 is fixably coupled to a corresponding column 364 with a plurality of connections 285 as previously described-one connection 285 is couples each tubular member 105 to a corresponding tubular member 105. In particular, each tubular member 275 is positioned adjacent one of the vertical tubular members 105 and is coupled to the lower end 105B of that tubular member 105 with one connection 285. As previously described, each connection 285 is a saddle-type connection in which the contoured end 275A, 275B of the tubular member 275 wraps partially around outer surface 110 of the corresponding tubular member 105 and is coupled directly thereto (e.g., welded). In this embodiment, connection 285 does not include any gussets or brackets extending between the coupled members 275, 105, however, in other embodiments, such features may be added.

In the embodiments shown in FIGS. 6 and 7, cavities 78 of tubular members 275 in each pontoon 262, 362 are structurally separated and isolated from each other, from tubular members 105 of columns 64, and from tubular members 275 of other pontoons 262, 362. However, in other embodiments, cavities 78 or their ballast tanks may be interconnected to other members 275 or columns 64 by plumbing.

Embodiments of pontoons 62, 262, 362 disclosed herein include axially-spaced annular stiffeners 79 disposed along the inner surface of the cylindrical side walls 77, 277 of the cylindrical tubular members 75, 275, but lack internal, longitudinal stiffeners. The circular tubular configuration of members 75, 275 along with the internal, annular stiffeners 79 provide structural integrity and rigidity while the connecting plates 82 and edge plates 84 function as external longitudinal stiffeners that enhance the structural integrity or rigidity of members 75, 275 and pontoons 62, 262, 362, as well as reduce heave.

While exemplary embodiments have been shown and described, modifications thereof can be made by one of ordinary skill in the art without departing from the scope or teachings herein. The embodiments described herein are exemplary only and are not limiting. Many variations, combinations, and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. The inclusion of any particular method step or operation within the written description or a figure does not necessarily mean that the particular step or operation is necessary to the method. The steps or operations of a method listed in the specification or the claims may be performed in any feasible order, except for those particular steps or operations, if any, for which a sequence is expressly stated. In some implementations two or more of the method steps or operations may be performed in parallel, rather than serially. The recitation of identifiers such as (a), (b), (c) or (1), (2), (3) before operations in a method claim are not intended to and do not specify a particular order to the operations, but rather are used to simplify subsequent reference to such operations.

What is claimed is:

1. A floating offshore structure for performing an offshore operation at an offshore site, comprising:

a buoyant hull including a first column, a second column, and a pontoon coupled to the first column and the second column, wherein each column is vertically oriented and the pontoon extends horizontally from the first column to the second column;

wherein each column has a central axis, an upper end, and a lower end;

a first external deck coupled to the lower end of the first column and a second external deck coupled to the lower end of the second column;

wherein each column comprises a plurality of vertically oriented tubular members, wherein each tubular member has an upper end, an open lower end, and a plurality of axially-stacked compartments positioned between the upper end of the tubular member and the lower end of the tubular member;

wherein the first external deck closes the open lower end of each tubular member of the first column to define a bulkhead for a lowermost compartment of the plurality of compartments of each tubular member of the first column;

wherein the second external deck closes the open lower end of each tubular member of the second column to define a bulkhead for a lowermost compartment of the plurality of compartments of each tubular member of the second column;

wherein the first external deck extends horizontally beyond an outer perimeter of the lower end of the first column and the second external deck extends horizontally beyond an outer perimeter of the lower end of the second column;

wherein the first external deck and the second external deck are axially positioned below the pontoon;

wherein the pontoon includes a first tubular member, a second tubular member positioned laterally adjacent to the first tubular member, a first edge plate extending horizontally from the first tubular member, and a second edge plate extending horizontally from the second tubular member;

wherein each tubular member of the pontoon is configured to be disposed subsea and filled with ballast at the offshore site during the offshore operation, and each column is configured to provide buoyancy to the hull at the offshore site during the offshore operation;

wherein the first tubular member and the second tubular member are disposed between the first edge plate and the second edge plate;

wherein each tubular member has a central axis, a first end coupled to the lower end of the first column, and a second end coupled to the lower end of the second column;

where the central axis of the first tubular member and the central axis of the second tubular member are disposed in a common horizontal plane.

2. The offshore structure of claim 1, wherein the pontoon includes a connection plate extending horizontally from the first tubular member to the second tubular member of the pontoon, wherein the connection plate is fixably coupled to the first tubular member and the second tubular member.

3. The offshore structure of claim 1, wherein the first edge plate extends axially relative to the central axis of the first tubular member from the first end of the first tubular member to the second end of the first tubular member;

wherein the second edge plate extends axially relative to the central axis of the second tubular member from the first end of the second tubular member to the second end of the second tubular member.

4. The offshore structure of claim 3, wherein the first edge plate and the second edge plate are vertically centered relative to the first tubular member and the second tubular member.

5. The offshore structure of claim 1, wherein each tubular member of each column has an outer cylindrical surface.

6. The offshore structure of claim 1, wherein each tubular member of each column has an outer cylindrical surface extending axially from the upper end to the lower end;

wherein a first connection assembly couples the first end of the first tubular member of the pontoon to the lower end of one of the tubular members of the first column;

wherein a second connection assembly couples the first end of the second tubular member of the pontoon to the lower end of one of the tubular members of the first column;

wherein each connection assembly comprises a plurality of vertical brackets disposed along the outer surface of the corresponding tubular member of the column, wherein the vertical brackets of the first connection assembly define a circular recess that receives the first end of the first tubular member of the pontoon and the vertical brackets of the second connection assembly define a circular recess that receives the first end of the second tubular member of the pontoon.

7. The offshore structure of claim 1, wherein each tubular member of the pontoon has a circular cross-sectional shape.

8. The offshore structure of claim 7, wherein each tubular member of the pontoon includes a plurality of axially spaced internal annular stiffeners.

9. The offshore structure of claim 1, wherein the first edge plate and the second edge plate are disposed in the common horizontal plane.

10. A floating offshore structure for performing an offshore operation at an offshore site, comprising:

a buoyant hull including a first column, a second column, and a pontoon extending from the first column to the second column;

wherein each column is vertically oriented and has a central axis, an upper end, and a lower end;

a first external deck coupled to the lower end of the first column and a second external deck coupled to the lower end of the second column;

wherein each column comprises a plurality of tubular members wherein each tubular member has an upper end defining the upper end of the corresponding column, an open lower end defining the lower end of the corresponding column, and a plurality of axially-stacked compartments positioned between the upper end of the tubular member and the lower end of the tubular member;

wherein the first external deck closes the open lower end of each tubular member of the first column to define a bulkhead for a lowermost compartment of the plurality of compartments of each tubular member of the first column; and wherein the second external deck closes the open lower end of each tubular member of the second column to define a bulkhead for a lowermost compartment of the plurality of compartments of each tubular member of the second column;

wherein the first external deck extends horizontally beyond an outer perimeter of the lower end of the first column and the second external deck extends horizontally beyond an outer perimeter of the lower end of the second column;

wherein the pontoon includes a first cylindrical tubular member, a second cylindrical tubular member oriented parallel to the first tubular member, a first heave plate extending horizontally from the first cylindrical tubular member, and a second heave plate extending horizontally from the second cylindrical tubular member;

wherein each tubular member of the pontoon is configured to be disposed subsea and filled with ballast at the offshore site during the offshore operation, and each column is configured to provide buoyancy to the hull at the offshore site during the offshore operation;

wherein the first cylindrical tubular member and the second tubular member are disposed between the first heave plate and the second heave plate, wherein the first heave plate and the second heave plate are configured to dampen vertical movement of the floating offshore structure;

wherein the second cylindrical tubular member is positioned laterally adjacent to the first cylindrical tubular member, wherein each tubular member is horizontally oriented and has a central axis, a first end coupled to the lower end of the first column, and a second end coupled to the lower end of the second column.

11. The offshore structure of claim 10, wherein the pontoon includes a connection plate extending horizontally from the first cylindrical tubular member to the second cylindrical tubular member, wherein the connection member is laterally positioned between the first heave plate and the second heave plate.

12. The offshore structure of claim 10, wherein the first heave plate extends axially relative to the central axis of the first cylindrical tubular member from the first end of the first cylindrical tubular member to the second end of the first cylindrical tubular member;

wherein the second heave plate extends axially relative to the central axis of the second cylindrical tubular member from the first end of the second cylindrical tubular member to the second end of the second cylindrical tubular member.

13. The offshore structure of claim 10, wherein the first heave plate and the second heave plate are disposed in a common horizontal plane.

14. The offshore structure of claim 13, wherein the central axis of the first tubular member and the central axis of the second tubular are disposed in the common horizontal plane.

15. The offshore structure of claim 10, wherein each tubular member of each column has an outer cylindrical surface.

* * * * *